US005275398A

United States Patent [19]

Compton

[11] Patent Number: 5,275,398

[45] Date of Patent: Jan. 4, 1994

[54] APPARATUS FOR POOL AND BILLIARD GAMES

[76] Inventor: Kenneth C. Compton, 2278 E. Williamson, Burton, Mich. 48529

[21] Appl. No.: 987,444

[22] Filed: Dec. 7, 1992

[51] Int. Cl.[5] ..... A63D 15/08

[52] U.S. Cl. ..... 473/2; 473/5; 473/31; 473/45

[58] Field of Search ..... 273/8, 9, 14, 68, 69, 273/70, 71, 129

[56] References Cited

U.S. PATENT DOCUMENTS

| | | | |
|---|---|---|---|
| 689,586 | 12/1901 | Haskell | 273/69 |
| 1,157,909 | 10/1915 | Teague | 273/69 |
| 3,463,593 | 8/1969 | Horan | 273/14 |
| 3,466,038 | 9/1969 | Hill | 273/14 |
| 3,858,882 | 1/1975 | Fox | 273/69 |
| 4,531,732 | 7/1985 | Harris | 273/14 |
| 4,688,796 | 8/1987 | Wright | 273/14 |
| 4,882,676 | 11/1989 | Kop | 273/14 |

*Primary Examiner*—Theatrice Brown
*Attorney, Agent, or Firm*—S. Michael Bender

[57] ABSTRACT

A new and improved apparatus for use with a pool or billiard table includes a stick assembly and arrays of light reflectors attached to the table, in parallel with the respective ball-rebounding surfaces. The stick assembly includes a stick and a laser unit connected to the stick. The laser unit includes a housing which is adjustably connected to a bracket which receives the stick. The stick can also include a spring-loaded ram assembly for striking a ball with a predetermined force that results from an amount of energy stored in a compressed spring. A trigger releases the compressed spring permitting the spring to drive the ram to strike a ball. To employ the apparatus for a straight shot, a first ball, which is to be struck by the stick, a second ball, which is to be struck by the first ball, and a target location, such as a pocket, are selected by a player. For the straight shot, as the first ball is struck by the stick, the stick, an aimed light beam, the first ball, the second ball, and the target location are maintained in alignment. To employ the apparatus for a bank shot, a light reflector array is positioned parallel to a ball-rebounding side of the table. For the bank shot, as the first ball is struck by the stick, the stick, the aimed light beam, the first ball, a light reflector, the second ball, and the target location are maintained in alignment.

8 Claims, 4 Drawing Sheets

APPARATUS FOR POOL AND BILLIARD GAMES

BACKGROUND OF THE INVENTION

1. Field of the Invention

The present invention relates generally to pool and billiard games, and more particularly, to an apparatus especially designed to improve accuracy in playing pool and billiards.

2. Description of the Prior Art

The games of pool and billiards are very popular and are enjoyed by many persons. In playing these games, accuracy in aiming and shooting is of primary importance.

In certain areas of the prior art, but not in the arts of pool or billiards, devices are well known that are employed to improve accuracy in aiming at a target. For example, U.S. Pat. No. 3,464,770 of Schmidt discloses a combined sighting mechanism and laser range finder used for ordnance such as for destroying a military tank vehicle. U.S. Pat. No. 3,610,755 of Wieberger discloses an optical sighting and/or observation set combined with a laser telemetry unit. U.S. Pat. No. 4,807,966 of Nakayama et al discloses a sighting apparatus that employs a laser oscillator, an optical system, a rotational table, and a movement conversion mechanism that converts movement on the rotational table into a linear movement through a motor and gearing. U.S. Pat. No. 4,939,863 of Alexander et al discloses a laser aiming device for firearms, archery bows, and crossbows. Special adjustment elements to compensate for wind and elevation are provided, and supports for those elements are also provided. U.S. Pat. No. 5,033,219 of Johnson et al discloses a modular laser aiming system for a hunter to use with a firearm. The modular nature of the device permits the laser aiming system to be used with a variety of optical telescope sights. It is noted that a laser is often used in the prior art sighting devices because of the straightness and sharpness of the laser beam.

Thus, while the foregoing body of prior are art indicates it to be well known to use lasers in sighting devices for targeting distant objects such as targets for ordnance, the provision of a simple and cost effective device for employing a laser in sighting for pool and billiards is not contemplated. In this respect, it would be desirable if a simple laser-based sighting apparatus were available for improving accuracy in playing pool and billiards.

A factor in playing pool and billiards that contributes to inaccurate shots is that ordinarily a player must successfully coordinate two difficult activities simultaneously. First, the player must accurately determine the desired path tha the struck ball is to follow. Second, the player must accurately move his hands and arms to move the pool stick in a proper path so that the pool stick accurately hits the ball at the desired orientation. In this respect, it would be desirable if an apparatus were available that reduced the necessity of simultaneously coordinating both accurate aiming and accurate moving of hands and arms in carrying out a pool or billiard shot.

The foregoing disadvantages are overcome by the unique apparatus for pool and billiard games of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved apparatus for use with a pool or billiard table. The apparatus includes a stick assembly and arrays of light reflectors attached to the table, in parallel with the respective ball-rebounding surfaces. The stick assembly includes a stick and a laser unit connected to the stick. The laser unit includes a housing which is adjustably connected to a bracket which receives the stick. The stick can also include a spring-loaded ram assembly for striking a ball with a predetermined force that results from an amount of energy stored in a compressed spring. A trigger releases the compressed spring permitting the spring to drive the ram to strike a ball. To employ the apparatus for a straight shot, a first ball, which is to be struck by the stick, a second ball, which is to be struck by the first ball, and a target location, such as a pocket, are selected by a player. For the straight shot, as the first ball is struck by the stick, the stick, an aimed light beam, the first ball, the second ball, and the target location are maintained in alignment. To employ the apparatus for a bank shot, a light reflector array is positioned parallel to a ballrebounding side of the table. For the bank shot, as the first ball is struck by the stick, the stick, the aimed light beam, the first ball, a light reflector, the second ball, and the target location are maintained in alignment.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least one preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved apparatus for pool and billiard games which has all of the advantages of the prior art and none of the disadvantages.

It is another object of the present invention to provide a new and improved apparatus for pool and billiard games which may be easily and efficiently manufactured and marketed.

It is a further object of the present invention to provide a new and improved apparatus for pool and billiard games which is of durable and reliable construction.

An even further object of the present invention is to provide a new and improved apparatus for pool and billiard games which is susceptible of a low cost of manufacture with regard to both materials and labor, and which accordingly is then susceptible of low prices of sale to the consuming public, thereby making such apparatus for pool and billiard games available to the buying public.

Still yet a further object of the present invention is to provide a new and improved apparatus for pool and billiard games that provides a simple laser-based sighting apparatus for improving accuracy in playing pool and billiards.

Yet another object of the present invention is to provide an apparatus that reduces the necessity of simultaneously coordinating both accurate aiming and accurate moving of hands and arms in carrying out a pool or billiard shot.

These together with still other objects of the invention, along with the various features of novelty which characterize the invention, are pointed out with particularity in the claims annexed to and form a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved apparatus for pool and billiard games embodying the principles and concepts of the present invention will be described.

Figure 1:
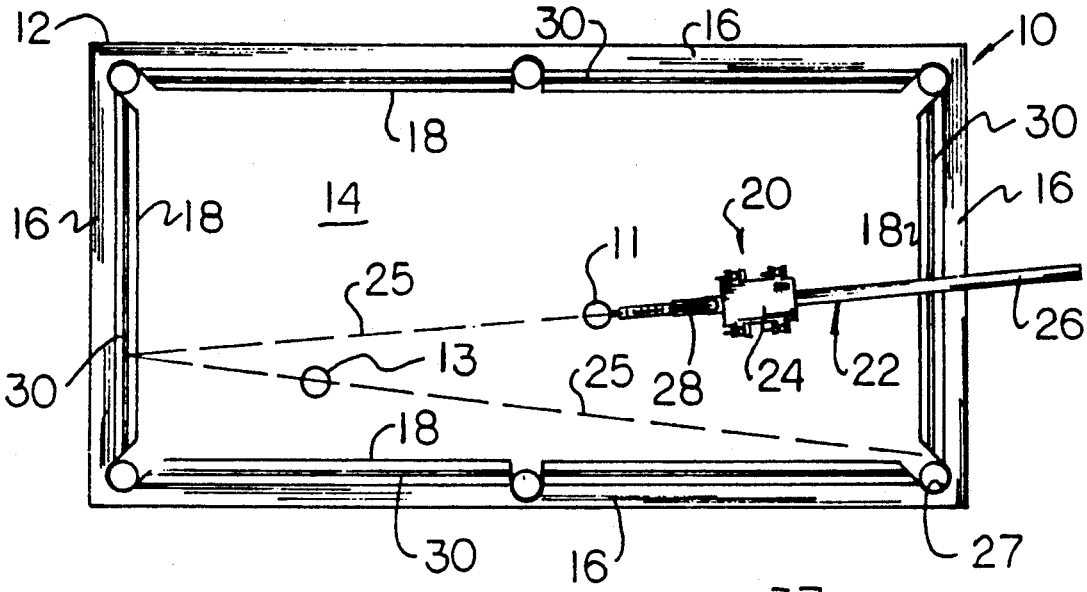
FIG. 1 is an overhead view showing a first preferred embodiment of the apparatus for pool and billiard games of the invention installed on a pool table.

Turning initially to FIG. 1, there is shown an exemplary embodiment of the apparatus for pool and billiard games of the invention generally designated by reference numeral 10. In its preferred form, apparatus 10 is used for pool and billiard games which use a plurality of balls 11 and 13 and a table 12 which has a flat playing surface 14 and which has a plurality of side rails 16 which include respective ball-rebounding surfaces 18 adjacent to the playing surface 14.

Figure 2:
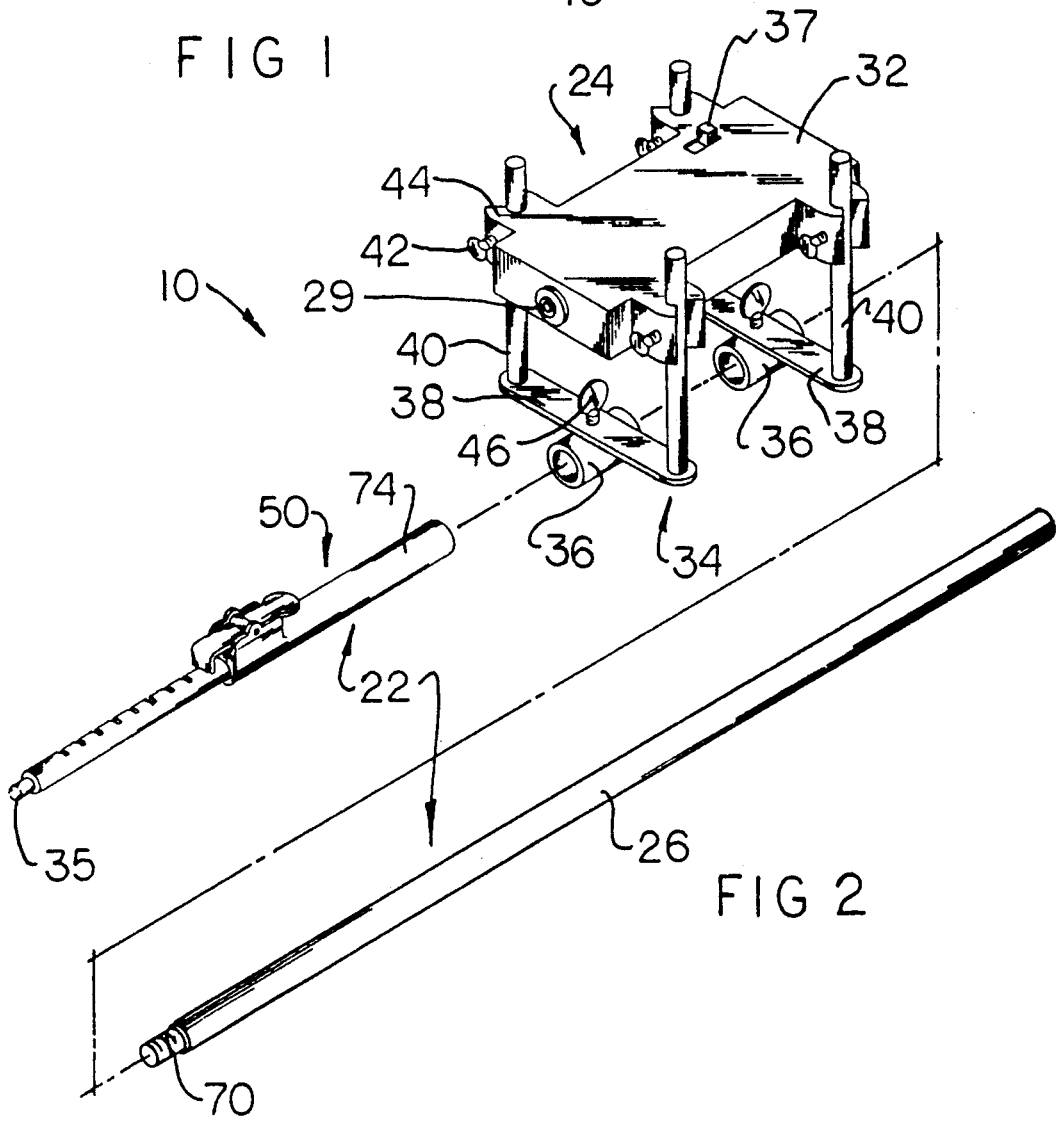
FIG. 2 is an exploded, enlarged perspective view of an embodiment of a stick assembly of the invention shown in FIG. 1.
Figure 3:
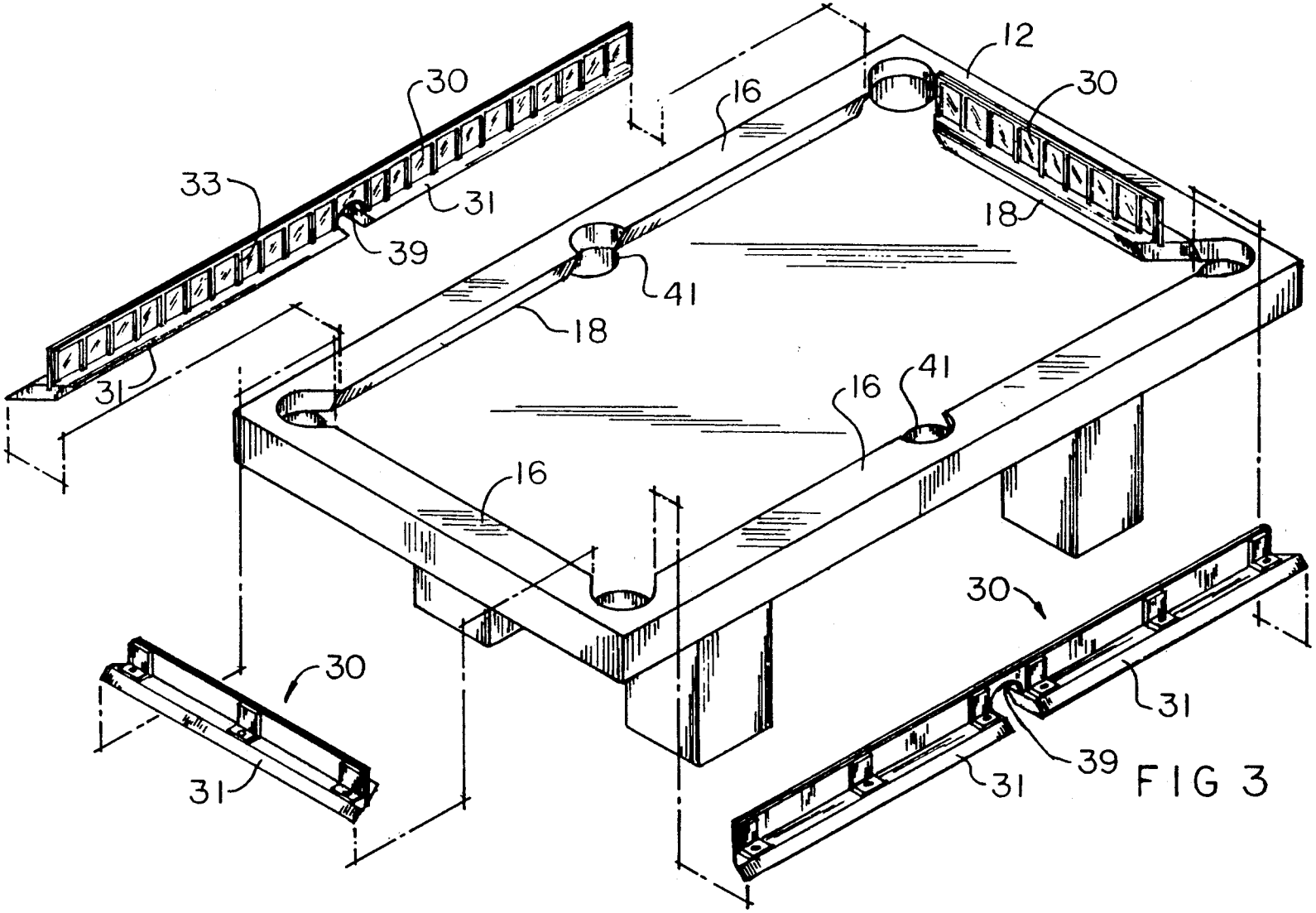
FIG. 3 is an exploded perspective view of an embodiment of a plurality of arrays of mirrors of the invention shown in FIG. 1.
Figure 4:
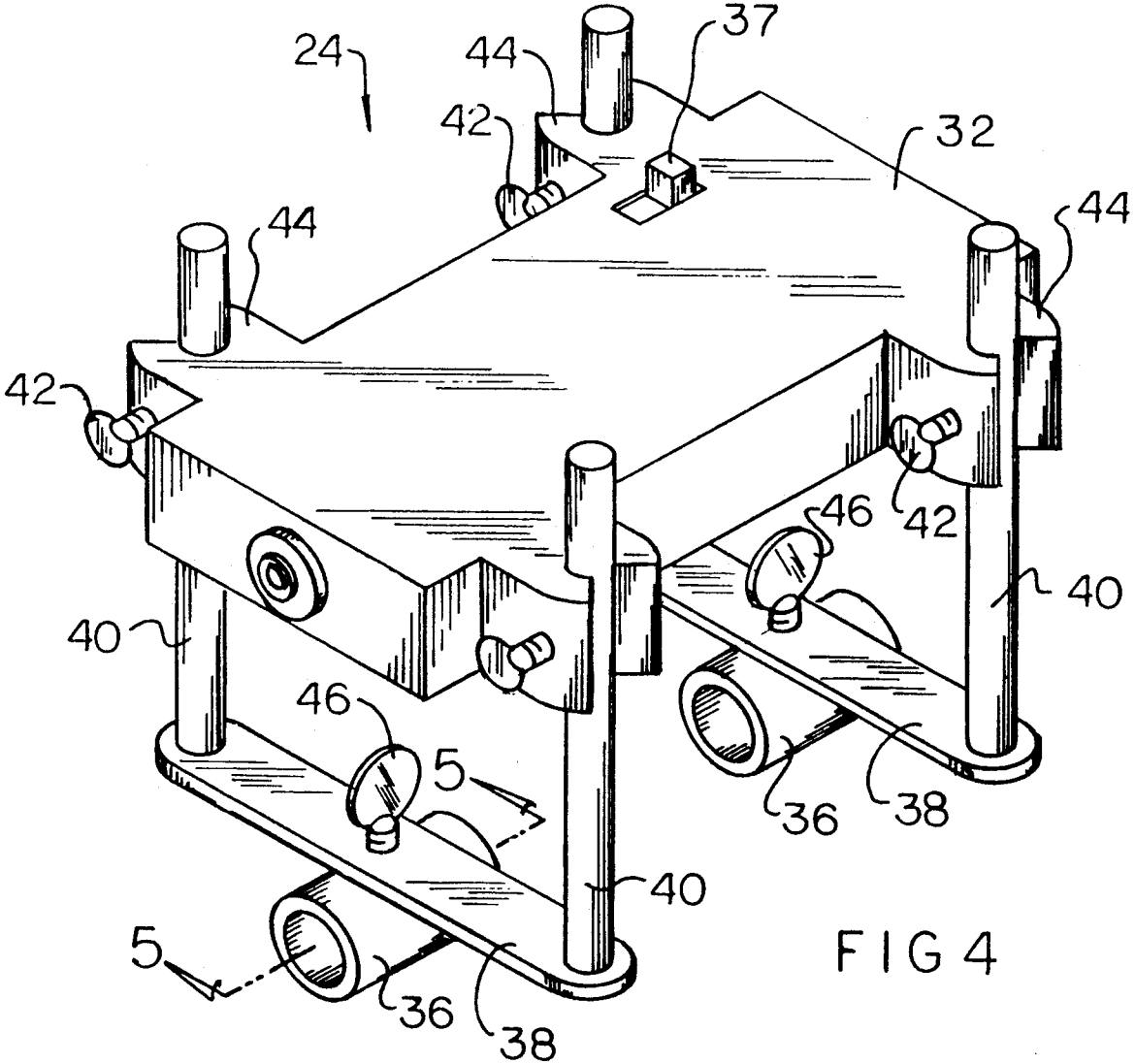
FIG. 4 is an enlarged perspective view of a combined laser unit and bracket for receiving a stick of the invention shown in FIG. 2.

More specifically, referring also to FIGS. 2, 3, and 4, the apparatus 10 for pool and billiard games includes a stick assembly 20 which includes a stick 22 and a laser unit 24 connected to the stick 22. The laser unit 24 is a source of a narrow, highly directional light beam 25 that emerges from lens 29. The laser unit 24 has an on-off switch 37 and is a self-contained and self-powered readily available unit. The stick 22 also includes a handle 26 and a ball-striking end 28 connected to the handle 26. The ball-striking end 28 also includes a tip 35. Arrays of light reflectors 30, supported on rail-like supports 31, are attached to the side rails 16 of the table 12, and they are oriented in parallel with the respective ball-rebounding surfaces 18. The reflectors 30 reflect the light beam 25 from the laser unit 24 toward a predetermined target location 27 (which is corner pocket 27 in FIG. 1) adjacent to the playing surface 14. The arrays of light reflectors 30 include guard elements 33 for protecting respective light reflectors 30 against being hit by a ball. In addition, the arrays of light reflectors 30 for the longer side rails 16 of the table 12 include side pocket arch 39 to allow a ball to pass into a side pocket 41 without bumping into the rail-like support 31.

Figure 5:
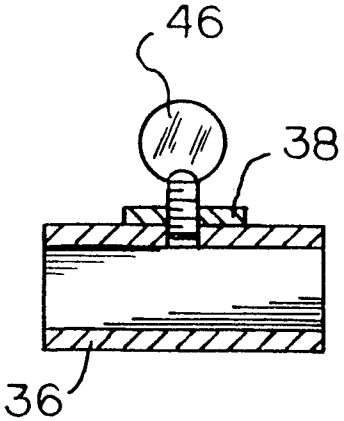
FIG. 5 is cross-sectional view of a cylindrical sleeve in the bracket shown in FIG. 4 taken along the line 5—5.

As shown most clearly in FIGS. 4 and 5, the laser unit 24 includes a housing 32 and bracket 34 for receiving the stick 22. The bracket 34 includes cylindrical sleeves 36 and horizontal support bars 38. Vertical rods 40 are connected to the horizontal support bars 38 and project up therefrom. Along with the bracket 34, the vertical rods 40 can be moved vertically up and down to adjust the position of the bracket 34 with respect to the laser unit 24. The vertical rods 40 are secured into adjusted positions by tightening wing-headed set screws 42 that screw into complementary threaded holes in guide members 44 that project from the laser housing 32. In essence, the adjustable vertical rods 40 are connected between the housing 32 and the bracket 34, and the rods 40 are used for positioning the bracket 34 with respect to the laser unit 24. The relationship between the bracket 34 and the laser unit 24 may be adjusted to compensate for different heights of the side rails 16 for different tables or may be adjusted to permit the player to use the apparatus 10 of the invention with a comfortable shooting position, such as when the laser beam 25 passes over a ball at a distance one-quarter to one-half inch above the ball.

As indicated in FIGS. 2, 4, and 5, additional wing-headed set screws 46 are used to secure a stick to the cylindrical sleeves 36 and the horizontal support bars 38 of the bracket 34.

Figures 6, 7:
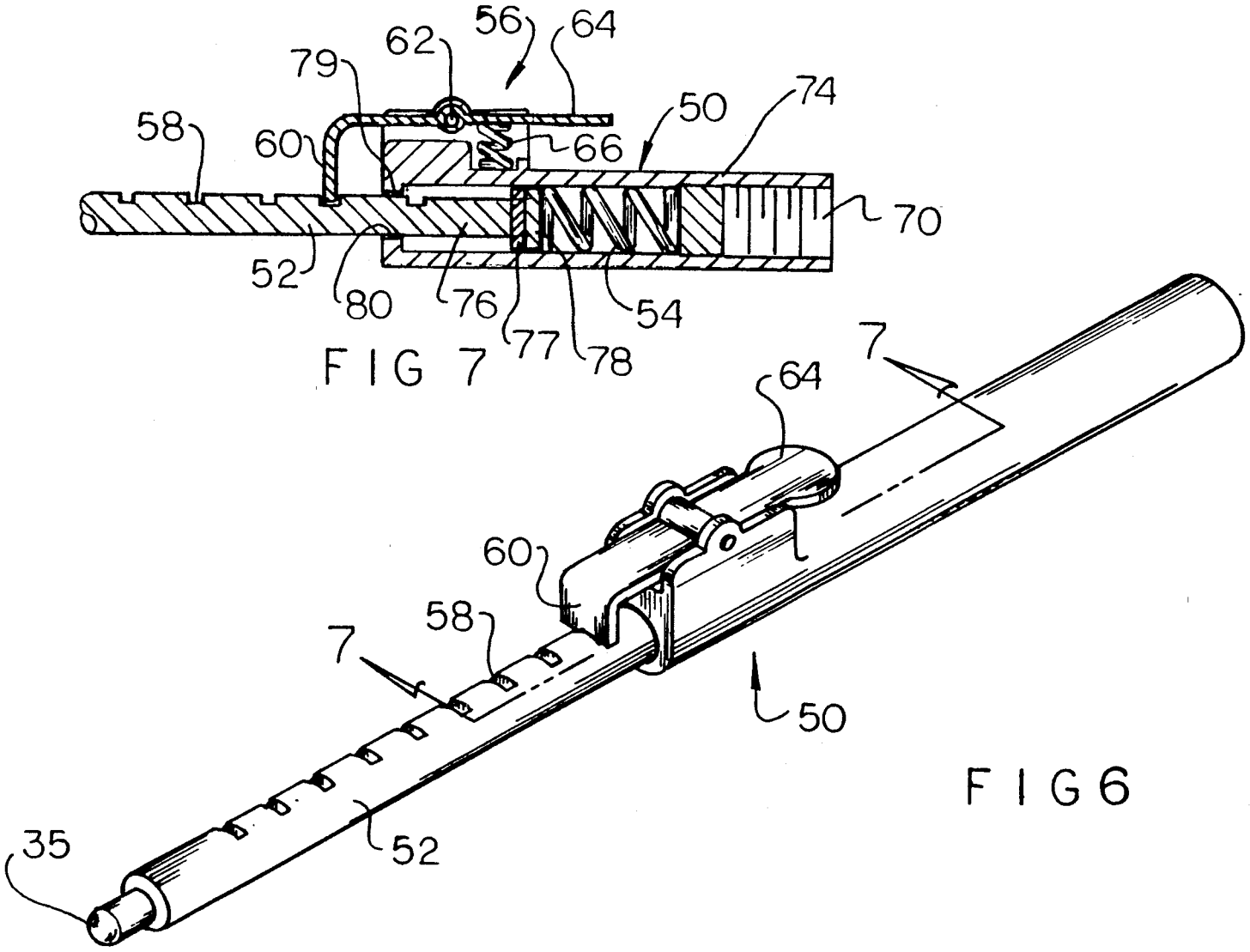
FIG. 6 is an enlarged perspective view of the spring-loaded ram assembly of the invention shown in FIG. 2.
FIG. 7 is a partial cross-sectional view of the spring-loaded ram assembly of the invention shown in FIG. 6 taken along the line 7—7.

As shown in FIGS. 6 and 7, another aspect of the apparatus 10 for pool and billiard games of the invention is shown in greater detail. In this embodiment, a ball-striking end of the stick 22 includes a ball-striking assembly 50 which includes a ram member 52 for striking a ball, a coiled spring 54 for loading the ram member 52 with a predetermined amount of stored energy for striking a ball, and a finger-actuated trigger 56 for releasing the stored energy such that the predetermined stored energy may be transmitted to a struck ball by the ram member 52.

The ram member 52 further includes a number of slotted graduations 58 for controlling the amount of stored force in the coiled spring 54. The force is stored in predetermined graduated amounts of stored energy based on the distance between the respective graduations 58 on the ram member 52. If desired, the graduations 58 can be grouped for convenience. For example, the first three slotted graduations can be used for short easy shots. The next three slotted graduations can be used for longer shots. And the last three slotted graduations can be used for hard shots such as breaking the preset assembly of balls.

The finger-actuated trigger 56 further includes a stop element 60, a hinged fulcrum 62, a finger-pressure area 64, and a biasing spring 66. As shown in FIG. 7, the stop element 60 is normally pressed into a slotted graduation 58 by the pressure exerted by biasing spring 66; and the ram member 52 is retained in a predetermined stored-force arrangement shown. However, when a finger-pressure would be applied downwardly upon the finger-pressure area 64, the biasing force exerted by the biasing spring 66 would be overcome, the stop element 60 would be lifted out of the slotted graduation 58, and the spring 54, retaining stored energy, would release the stored energy and thrust the ram member 52 outward to the left to strike a ball.

In operation, with reference to FIG. 1, the apparatus 10 for pool and billiard games of the invention is used as follows for a bank shot. A light reflector 30 is placed along a ball-rebounding surface 18 of the table 12 adjacent to the playing surface 14, and the light reflector 30 is placed parallel to the ball-rebounding surface 18. A first ball 11 (such as a cue ball) is selected to be to be struck by the stick 22. A second ball 13 is selected to be struck by the rebounding ball 11 that will rebound off of the far left surface 18. Once struck by the ball 11, the second ball 13 is intended to move to a selected predetermined target location, namely corner pocket 27. Before executing the bank shot, the stick 22 is adjusted and oriented by the player so that the stick 22, the aimed light beam 25, the first ball 11, a light reflector 30, the second ball 13, and the target location 27 are placed in alignment. As the bank shot is executed, that is as the first ball 11 is struck by the stick 22, the stick 22, the aimed light beam 25, the first ball 11, the light reflector 30, the second ball 13, and the target location 27 are maintained in alignment. When using a conventional stick, there is a need for the player to accurately move his hands and arms to move the pool stick in a proper path so that the stick accurately hits the ball at the desired orientation.

Alternatively, the apparatus 10 for pool and billiard games of the invention can be used for other kinds of pool or billiard shots such as straight shots. Before executing the straight shot, the stick 22 is adjusted and oriented by the player so that the stick 22, the aimed light beam 25, the first ball 11, a second ball (not shown), and the target location 27 are placed in alignment. As the straight shot is executed, that is as the first ball 11 is struck by the stick 22, the stick 22, the aimed light beam 25, the first ball 11, the second ball, and the target location 27 are maintained in alignment.

Alternatively, as before with respect to FIG. 1 for a bank shot, when the ball-striking assembly 50 is employed, the light beam 25 from the laser unit 24 is directed to pass over the center of ball 11 (to bisect ball 11), to be reflected from the light reflector 30, to pass over the center of the second ball 13 (to bisect ball 13), and to land at the predetermined target location which is corner pocket 27. However, when using the ball-striking assembly 50 of the invention as shown in FIGS. 6 and 7, there is no need for the player to accurately move his hands and arms to move the stick 22 in a proper path so that the pool stick accurately hits the ball at the desired orientation. Instead, when using the ball-striking assembly 50 of the invention, once the predetermined target location 27, the reflected light beam 25, the second ball 13, the reflector 30, the aimed light beam 25, the ball 11, and the ball-striking assembly 50 have been placed in proper alignment, the finger-actuated trigger 56 is actuated by the player, whereby the stop element 60 is lifted out of the slotted graduation 58, and the compressed spring 54 is released, permitting the spring 54 to release its compressed energy and to drive the ram element 52 toward the left (in FIG. 7) to strike the ball 11. As before, once the ball 11 is struck, ideally, the struck ball 11 will hit the portion of the ball-rebounding surface 18 under the reflector 30 and rebound along the path followed by reflected light beam 25 to then strike the second ball 13 which will be driven into the corner pocket 27.

The ball-striking assembly 50 can include a threaded end 70 (shown in FIG. 7) for receiving a complementarily threaded end 72 on a stick handle 26 (shown in FIG. 2). The ball-striking assembly 50 has a housing 74 in which is contained the spring 54 and a proximal end 76 of the ram 52. At a terminus 78 of the proximal end 76, the terminus 78 is T-shaped. The T-shape provides a large surface area for one end of the spring 54 to push on; and the T-shape provides an oversize end of the ram 52 to prevent the ram 52 from being expelled from the housing 74 when the spring 54 is released. More specifically, the outer diameter of the T-shaped terminus 78 is greater in diameter than the inner diameter of the orifice 80 in the housing 74 through which the graduated portion of the ram 52 slides. An annular rubber gasket 77 is fitted onto the ram member 52 near the T-shaped terminus 78. When the spring tension is released and the ram 52 is forced to the left in FIG. 7, the annular rubber gasket 77 absorbs some of the shock and deadens some of the sound when the T-shaped terminus 78 hits the flange 79 surrounding the orifice 80. If desired, the housing 74 can be jacketed by a hand grip (not shown). Also, if desired, bi-pod wheels (not shown) can be affixed to the ram member 52 near the tip 35.

A wide variety of inexpensive and easily processed materials can be used for fabricating some of the elements of the apparatus 10 for pool and billiard games of the invention. For example, the shaft or handle of the stick could be made from wood, plastic, steel, or aluminum. The shaft could be drilled or molded with a one inch diameter to house the coiled spring and the ram member. A metal trigger could be assembled onto the shaft. The array of light reflectors could employ a light-reflective strip, such as made from MYLAR(TM) that could be secured to its support by a hook and loop fastener or by a mild adhesive.

It is apparent from the above that the present invention accomplishes all of the objects set forth by providing a new and improved apparatus 10 for pool and billiard games that is low in cost, relatively simple in design and operation, and which may advantageously be used to improve accuracy in the shots that are executed.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularly and detail in connection with what is presently deemed to be the most practical and preferred embodiment(s) of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by LETTERS PATENT of the United States is as follows:

1. A new and improved game apparatus for use with a plurality of balls and a table which has a flat playing surface and which has a plurality of side rails which include respective ball-rebounding surfaces adjacent to the playing surface, the apparatus comprising:

a cue stick assembly which includes a cue stick and a source of a narrow, highly directional light beam connected to said cue stick, wherein said cue stick includes a handle and a ball-striking end connected to said handle, wherein said light beam source includes:

a laser in a housing;

a bracket for receiving said cue stick; and adjustable means, connected between said housing and said bracket, for positioning said bracket with respect to said laser.

2. The apparatus described in claim 1, further including:

an array of light reflectors, attached to a side rail of the table, in parallel with a respective ball-rebounding surface, for reflecting the light beam from the light beam source toward a predetermined target location on or adjacent to the playing surface.

3. The apparatus described in claim 2 wherein said array of light reflectors is supported by a longitudinal support engaged with said side rails of said table.

4. The apparatus described in claim 2 wherein said array of light reflectors include guard elements for protecting respective light reflectors against being hit by a ball.

5. The apparatus described in claim 1 wherein said ball-striking end of said stick includes a ball-striking assembly which includes:

a ram member for striking a ball;

means for loading said ram member with a predetermined amount of stored energy for striking a ball; and means for releasing the stored energy such that the predetermined stored energy is transmitted to a struck ball by means of said ram member.

6. The apparatus described in claim 5 wherein said ram member includes a number of graduations for controlling storage of predetermined graduated amounts of stored energy.

7. The apparatus described in claim 5 wherein said means for loading said ram member with the stored energy includes a coiled spring.

8. The apparatus described in claim 5 wherein said means for releasing the stored energy includes a spring-biased trigger for engaging said graduations on said ram member.

* * * * *